United States Patent [19]

Denker

[11] Patent Number: 4,789,018

[45] Date of Patent: Dec. 6, 1988

[54] SHAPER CUTTERHEAD ASSEMBLY WITH ABSOLUTELY CAPTIVE BITS

[76] Inventor: James M. Denker, 711 First Parish Rd., Scituate, Mass. 02066

[21] Appl. No.: 141,583

[22] Filed: Jan. 7, 1988

[51] Int. Cl.[4] ..... B27G 13/00

[52] U.S. Cl. ..... 144/231; 144/235; 144/241

[58] Field of Search ..... 144/218, 228, 229, 231, 144/234, 235, 236, 241

[56] References Cited

U.S. PATENT DOCUMENTS

| | | | |
|---|---|---|---|
| 82,699 | 10/1868 | Farmer | 144/231 |
| 768,625 | 8/1904 | Quinn | 144/231 |
| 1,014,794 | 1/1912 | Weirbach | 144/231 |
| 1,016,253 | 2/1912 | Denegar | 144/231 |
| 1,655,828 | 1/1928 | Weaver | 144/234 |
| 2,622,640 | 12/1952 | Pardee | 144/231 |
| 2,963,060 | 12/1960 | Walther | 144/235 |

*Primary Examiner*—W. Donald Bray
*Attorney, Agent, or Firm*—Hale and Dorr

[57] ABSTRACT

Disclosed is a shaper cutterhead utilizing an assembly that locates, captivates and firmly clamps two standard cutter bits that each include a hole designed to be engaged by solid lugs of a hub. Tee-slotted clamping collars that surround the hub slide laterally into place by engaging grooves in both bits and lock the bits rigidly when the machine spindle is tightened.

7 Claims, 1 Drawing Sheet

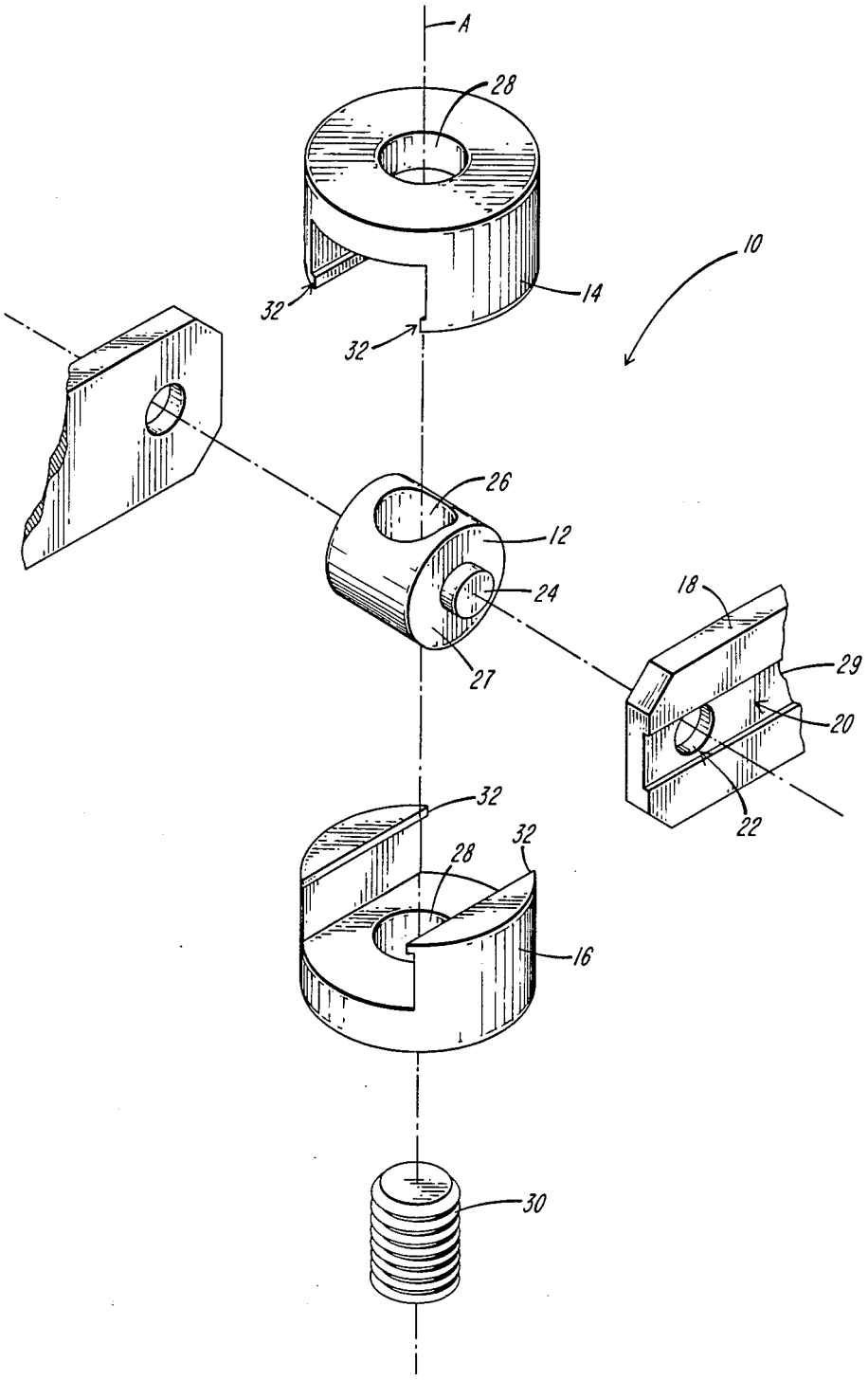
A
28
10
14
32
32
26
12
24
18
29
27
20
22
32
32
28
16
30

SHAPER CUTTERHEAD ASSEMBLY WITH ABSOLUTELY CAPTIVE BITS

BACKGROUND OF THE INVENTION

The present invention relates to a shaper cutterhead assembly and more particularly to a shaper cutterhead assembly that securely and reliably retains the cutter bits.

Shaper cutterheads are traditionally used in large woodworking shops for production runs, and in many smaller woodworking shops for producing custom molding, plaques, picture frames, and all kinds of shapings. Cutter bits, which make the cut in the wood, are available in many different configurations, and each different configuration cuts its own designed pattern.

The cutter bits are generally interchangeable, and as a result they must be secured to the cutterhead assembly. Typically, screws secure the bits to the cutterhead, and an example of such a securing system is shown in U.S. Pat. No. 3,731,991. The screws in these systems, however, can loosen. If the screws do loosen, the cutterbits are then no longer securely held by the cutterhead, and they could fly out of the cutterhead as the cutterhead rotates at a high speed.

It is therefore a principal object of the present invention to provide a shaper cutterhead assembly having easily replaced, low-cost standard bits, is of a small size and avoids the dangers associated with other cutterheads which rely only upon screws to retain their bits.

Another object of the present invention is to provide a cutterhead assembly having bits that can be changed simply and quickly without tools, and which is not subject to the usual damage and wear from continued tightening (and often overtightening) of the clamping screws.

SUMMARY OF THE INVENTION

Accordingly, the shaper cutterhead of the present invention utilizes an assembly that locates, captivates and firmly clamps two standard cutter bits, which are available at a low cost in a variety of shapes for use in other commercial cutterheads that employ screws for bit retention. Each bit includes a hole engaged by solid lugs of a hub. After the bits are secured to the hub, tee-slotted clamping collars slide laterally into place by engaging grooves in both bits and lock the bits rigidly when the assembly is fitted over a machine spindle and the spindle nut is tightened.

These and other objects and features of the present invention will be more fully understood from the following detailed description which should be read in light of the accompanying drawing.

BRIEF DESCRIPTION OF THE DRAWING

FIG. 1 is an exploded perspective view of a shaper cutterhead assembly of the present invention.

DETAILED DESCRIPTION OF THE PREFERRED EMBODIMENTS

The shaper cutterhead assembly 10 of the present invention includes a hub 12 and two identical clamping collars 14, 16, each of which has a central bore 28 sized for a slip fit on the spindle 30 of a wood shaper machine.

One standard line of molding cutter bits 18 that appears to be the most readily available at low cost employs a basic blank which is provided with a longitudinal locating groove 20 centered on its back face. Each bit 18 also includes a hole 22 located on the center line of the groove 20 at a distance from the back end. While in prior art cutterhead assemblies (e.g. a slotted-disk type molding head) this hole 22 is intended to receive the tip of a clamping screw which would jam the bit against its seat, the hole size and location on the bit are actually produced to accurate tolerances.

The cutterhead assembly 10 uses the hole 22 in each bit as the primary means for locating the bit by attaching the hub 12 to the two bits by engaging each hole 22 with a solid lug 24. The cylindrical central hub 12 has two lugs 24 located at the centers of two flat and parallel seats 27 which are equally spaced from a central diametral hole 26. When the bits 18 are seated against these flat surfaces 27, the lugs do not protrude into the grooves 20 in the back faces of the bits 18. The bits 18 are aligned with the lugs 24 so that the cutting edges 29 both face forward with respect to the direction of rotation about the axis A of the central hole 26.

The two identical clamping collars 14, 16 each have a central axial hole 28 that provides a free fit on the machine spindle 30. Each of the collars 14, 16 has a central diametral tee-slot across its face. This tee-slot has dimensions which permit the collar to slide laterally over the cutter bits 18 when they are aligned on the lugs 24 of the hub 12. The lips 32 of the tee-slots engage the grooves 20 on the back faces of both cutter bits 18 but do not extend to the centers of the grooves 20 so that both collars can slide into place without any interference from the lips 32 of the other collar.

With both collars 14, 16 in place, and their center holes 28 aligned with the crosshole 26 in the hub 12, the assembly can then be slid onto the machine spindle 30. The cutting bits 18 are now fully captive, located by the lugs 24 of the hub 12, and housed by the tee-slots of the two collars 14, 16. The bits 18 cannot be separated from the cutterhead assembly 10 as long as its parts are kept aligned by the spindle 30.

An anti-rotation (keyed) washer and spindle nut (not shown) together with any required rub-collars and spacers to suit the work to be performed, are then installed on the spindle and tightened in a known manner. The clearance provided between the clamping collar lips allows the bottoms of their tee-slot to bear directly on the side edges of both cutting bits 18, thus clamping both bits solidly between the collars 14, 16 as the spindle nut is tightened. It should be particularly noted that if the spindle nut ever becomes loose in operation, the cutterhead assembly will merely slip while the spindle continues to rotate. The cutting bit cannot be thrown from the head no matter how loose the spindle nut becomes. The cutterhead 10 is intrinsically just as safe as any solid, one-piece cutter, as bit retention in no way depends upon the operator's judgment in the tightening of several individual clamping or jam screws.

Wood shapers perform both right-hand and left-hand cuts on some workpieces, and it is necessary to be able to turn the cutterhead assembly upside down in order to reverse the spindle rotation direction. Since the cutterhead is symmetrical, this can be done without affecting its function in any way. Light-duty shapers (i.e. those having a one-half inch diameter spindle) are difficult and/or unsafe to operate with cutterheads larger than can fit through their table cut-outs. Because it uses no clamp screws, the cutterhead assembly, according to the present invention, is able to place the two cutter bits very nearly tangent to the machine spindle itself. Thus, its cutting envelope is reduced, thereby allowing proper and safe use of any light-duty wood shaper at the maximum spindle speeds at which such machines are designed to operate with solid cutters.

While the foregoing invention has been described with reference to its preferred embodiments, various alteration and modifications may occur to those skilled in the art. All such alterations and modifications are intended to fall within the scope of the appended claims.

What is claimed is:

1. A cutterhead assembly for performing woodworking operations, said assembly including at least one cutter bit having a longitudinal groove in one face thereof and an opening through the cutter bit located within the groove, said assembly comprising:

a hub having a central opening therethrough and a lug extending from each of two opposite ends of said hub, said lug having dimensions that enable said lug to fit within the opening in the groove of the bit;

an upper collar and a lower collar each having a central opening alignable with said central opening of said hub when said collars are placed around said hub, each of said collars having two lips with each lip being engageable with one side wall of the groove of the bit.

2. The cutterhead assembly of claim 1 wherein each of said collars further comprises a base through which the central opening in the collar extends and two side walls which extend from said base in parallel directions, the edge of each side wall opposite the edge attached to said base includes said lip.

3. The cutterhead assembly of claim 2 wherein the distance between said lip and said face of said side wall is just slightly greater than the distance between the edge of the cutter bit and the edge of the groove of the cutter bit.

4. The cutterhead assembly of claim 2 wherein the distance between the said side walls is slightly greater than the distance from one lug of said hub to the end of the opposite lug of said hub.

5. The cutterhead assembly of claim 1 wherein the central openings are of a diameter sufficient to receive a machine spindle.

6. The cutterhead assembly of claim 1 wherein said cutterhead assembly is symmetrical thereby allowing said cutterhead assembly to be turned upside down to reverse the spindle rotation direction.

7. A cutterhead assembly for performing woodworking operations, said assembly including at least one cutter bit having a longitudinal groove in one face thereof, said assembly comprising:

a hub having a central opening therethrough and means for attaching itself to the bit;

an upper collar and a lower collar each having a central opening alignable with said central opening of said hub when said collars are placed around said hub, each of said collars having two lips with each lip engageable with one side wall of the groove of the bit.

* * * * *